US006941791B1

(12) United States Patent
Sanders et al.

(10) Patent No.: US 6,941,791 B1
(45) Date of Patent: Sep. 13, 2005

(54) DASH BRIDGE AND HOOK RESCUE DEVICE

(76) Inventors: Alan Sanders, 4722 N. Henney Rd., Choctaw, OK (US) 73020; Shane Campbell, 5721 Valley Way, Oklahoma City, OK (US) 73150

( * ) Notice: Subject to any disclaimer, the term of this patent is extended or adjusted under 35 U.S.C. 154(b) by 82 days.

(21) Appl. No.: 10/737,086

(22) Filed: Dec. 16, 2003

Related U.S. Application Data

(60) Provisional application No. 60/436,213, filed on Dec. 23, 2002.

(51) Int. Cl.[7] ..... B21J 13/08
(52) U.S. Cl. ..... 72/458; 72/392; 72/464; 72/705; 254/93 R
(58) Field of Search ..... 72/392, 457, 458, 72/464, 705; 254/93 R, 104, 133 R, 134

(56) References Cited

U.S. PATENT DOCUMENTS 3,819,153 A * 6/1974 Hurst et al. ..... 254/93 R
3,985,014 A 10/1976 Smith
4,201,368 A * 5/1980 Vetter ..... 254/131
4,531,289 A 7/1985 Brick
4,732,029 A 3/1988 Bertino
4,762,304 A 8/1988 Hill
4,973,028 A 11/1990 Linster
5,174,148 A * 12/1992 Thomas et al. ..... 72/392
5,267,462 A 12/1993 Pijanowski
5,289,711 A * 3/1994 Spiegel ..... 72/392
5,421,230 A 6/1995 Flaherty et al.
5,425,260 A 6/1995 Gehron
6,318,144 B1 11/2001 Keeble

* cited by examiner

*Primary Examiner*—Ed Tolan
(74) *Attorney, Agent, or Firm*—Randal D. Homburg

(57) ABSTRACT

The dash bridge and hook rescue device is a two piece emergency rescue tool utilized in the extraction of accident victims from underneath a dashboard and steering column as the result of an automobile accident where severe injuries are incurred by the victim. The rescue device is used to expedite the lifting and removal of the steering column and dashboard using existing winches, power spreaders or extension ram devices, either manual, air or hydraulic powered, to engage the hook attached below the steering column and lift it from the dash bridge spanning from the hood of the car to the roof of the car, bridging the windshield through which the hook extends, and lifting the steering wheel in a vertical direction off the lap and chest of the victim. Unrestricted access to the victim from the passenger compartment of the vehicle and transfer to emergency transport vehicles for critical care is expedited over other existing emergency extraction device techniques.

10 Claims, 10 Drawing Sheets

DASH BRIDGE AND HOOK RESCUE DEVICE

CROSS REFERENCE TO RELATED APPLICATIONS

Provisional Patent Application No. 60/436,213 filed Dec. 23, 2002.

I. BACKGROUND OF INVENTION

1. Field of the Invention

The dash bridge and hook rescue device is a two piece emergency rescue tool utilized in the extraction of accident victims from underneath a dashboard and steering column as the result of an automobile accident where severe injuries are incurred by the victim. The rescue device is used to expedite the lifting and removal of the steering column and dashboard using existing winches, power spreaders or extension ram devices, either manual, air or hydraulic powered, to engage the hook attached below the steering column and lift it from the dash bridge spanning from the hood of the car to the roof of the car, bridging the windshield through which the hook extends, and lifting the steering wheel in a vertical direction off the lap and chest of the victim. Unrestricted access to the victim from the passenger compartment of the vehicle and transfer to emergency transport vehicles for critical care is expedited over other existing emergency extraction device techniques.

2. Description of Prior Art

The following United States patents are identified and disclosed herein. Several devices are disclosed relating to emergency rescue tools and steering column lifting device requiring the use of chains or devices used to cut windshields. However, none of them involve the same elements or relationship of component elements defined by the present dash bridge and hook rescue device.

The first prior art device, U.S. Pat. No. 3,982,014 to Smith, discloses a very large frame which either fits over or under an entire automobile which has winches attached to two ends to pull a collapsed automobile apart. U.S. Pat. No. 4,732,029 to Bertino discloses a hood bridge which allows for the placement of two chains, one end having a pulley or a fulcrum over which the chain is allowed to pull in a perpendicular direction, the two chains placed within the device holding two chains and forcing them together to lift the steering column, which has been wrapped with one piece of the chain and hooked around the column. A fluid operated door opening device, including a pair of hydraulic piston rams used to pry open a door or other structure, is shown in U.S. Pat. No. 4,762,304 to Hill.

A windshield saw using compressed air is disclosed in U.S. Pat. No. 5,421,230 to Flaherty, which allows for a rescue worker to cut through automobile glass to gain access to the occupant of the vehicle during an emergency rescue situation. In U.S. Pat. No. 5,425,260 to Gehron a T-bar with an extending levered arm is placed on the hood of a damaged vehicle, after which a chain winch is attached to the T-bar which has been anchored to the front of the vehicle, and a second chain is attached to the levered arm and the steering column, the chain winch forcing the levered arm towards the front of the vehicle, lifting the steering column by the chain wrapped around the steering column. A very similar device is disclosed in U.S. Pat. No. 6,318,144 to Keeble, except that a passenger side air bag shredder is included on the T-bar to puncture any passenger side air bag which might deploy during rescue operations.

All the device disclosed above, including Keeble, Gehron, and Bertino, do address the issue of raising a steering column, but all of them require gaining access to the passenger compartment and then attempting to wrap a chain around a steering column that is blocked by the very victim they are trying to extricate from the vehicle (FIG. 1). They do not provide a means to punch a hole in the windshield, nor to cut the windshield glass away from the working area. They also require anchoring the device to the front of the vehicle, which may be damaged to a point in a head-on collision, the front of the vehicle generally lacking enough stability to be used as a reliable anchor.

The current device requires no access to the passenger compartment to engage the steering wheel, since access is gained through the windshield wherein the hook engages the underside of the steering wheel by mere insertion and lifting of the hook, while the bridge is placed on the roof and hood of the car with the hook being lifted straight up by some forced means, the bridge acting as a stable base for the applied lifting force. The hook is also used to pierce the windshield, rip an opening in the windshield and lift the steering column, while also available for use as a prying mechanism for metal or other damaged items on an automobile after a collision.

II. SUMMARY OF THE INVENTION

The dash bridge and hook are a two piece tool used for extraction of a victim from an automobile where the driver or a passenger is pinned beneath a steering wheel or dashboard in the interior or the vehicle. It is recognized in emergency rescue efforts that time is of the essence, and the extraction of a victim needs to be accomplished in the least amount of time to optimize the chance of recovery and emergency care attendance in a hospital after a serious accident. In head-on collisions, it is also recognized that more often than not, a driver or passenger is pinned beneath the dashboard and behind the steering wheel of the vehicle, requiring removal of the steering wheel and the collapsed dashboard from the victim to remove the victim from the interior of the vehicle.

Conventional and prior art methods (FIG. 1) for the removal of the steering wheel and dashboard have required the use of a chain, wrapped underneath and around the steering column with the chain being extended through the windshield. Another chain is then hooked to whatever is left of the front of the vehicle as an anchor, and an extension ram is used to pull the two chains together to pull the steering wheel and dashboard towards the front of the vehicle with hope of removing the steering column from the chest and lap of the driver or passenger. Thus, it is required that access be available to connect the chain to the steering column and to the front of the car, if any, for the two chains to be connected to begin the pulling process. Often, there is nothing on the front of a vehicle to attach a chain, and access to the steering column from the side and below requires access to the area, which generally involves encroachment into the area where the injured driver is located and pinned.

Using the current device, it is the objective of the device to create a stable pressure point for lifting by positioning the dash bridge over the windshield area above the steering column with one end resting on the hood area of the vehicle and the other end resting on the roof of the vehicle while using the hook to penetrate the windshield from the side and placing the hook through the windshield and dropping the attaching end of the hook down from the hole, below the steering column and catching the steering column from below without need to gain access and hook a floppy chain to the steering column. The hook must be very rigid and sturdy, with the end extending above and through the windshield being oriented above the bridge, wherein an extension ram or spreader is used to force the hook away from the bridge, lifting the steering column and dashboard in a direction, off of and away from the pinned victims.

III. DESCRIPTION OF THE DRAWINGS

The following drawings are informal drawings submitted with this provisional patent application.

FIG. 6 is an isolated side perspective view of the piercing end of the hook tool.

FIG. 12 is an upper perspective view of the dash bridge in an open position.

FIG. 13 is a bottom view of the dash bridge in an open position demonstrating the hood support and roof support movement from an open position to a closed position.

FIG. 14 is a side view of the dash bridge in an open position demonstrating the sliding adjustability of the hood support and roof support along the main support member.

FIG. 16 is a view of the roof support end of the dash bridge with the accessory winch attachment.

IV. DESCRIPTION OF THE PREFERRED EMBODIMENT

Figure 1:
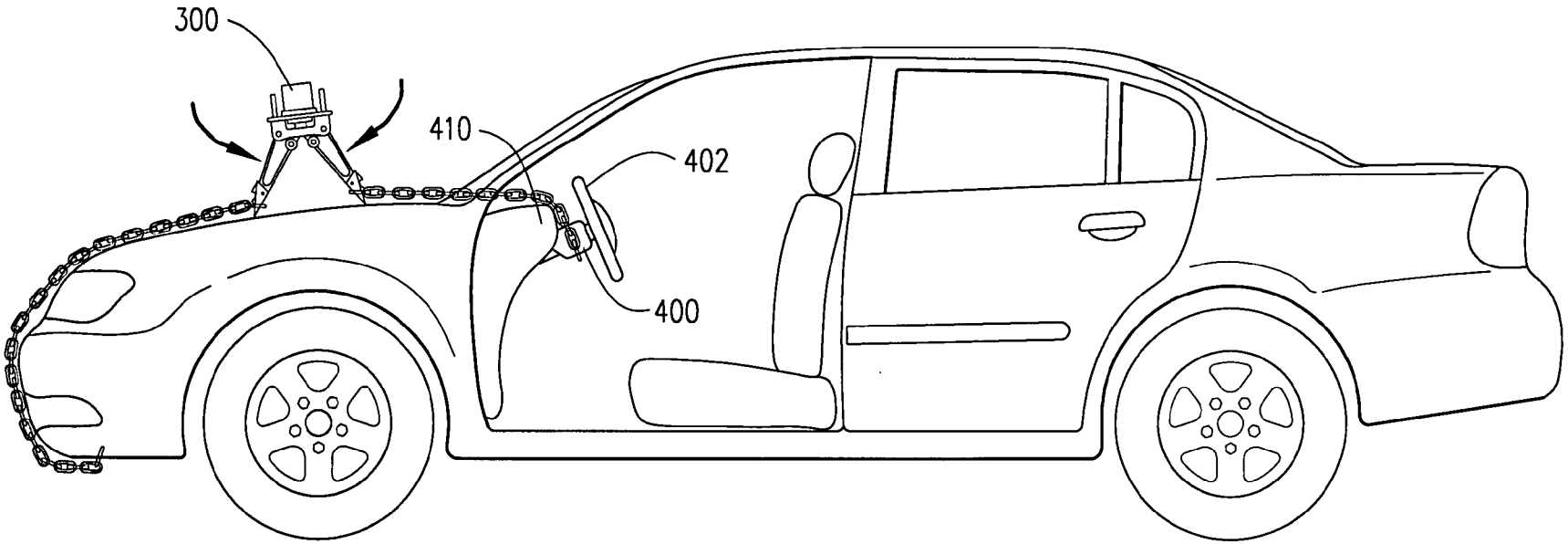
FIG. 1 PRIOR ART
FIG. 1 is a drawing of the prior art and conventional technology to pull a steering columns.

A dash bridge and hook rescue device, as shown and disclosed in FIGS. 2–16 of the drawings, is an emergency rescue tool for use with a manual or powered forcing means or spreader to remove and elevate a collapsed automobile steering column 400 and dashboard 410 in an automobile having a hood 420, a roof 430 and a windshield 440, subsequent to an automobile collision in order to extract a driver or passenger from the automobile that is pinned within the automobile. The emergency rescue tool comprises essentially a hook tool 10 and a dash bridge 100 spanning from the hood 420 of the automobile to the roof 430 of the automobile, the hook tool 10 being a multiple use tool use for prying, penetrating, cutting automobile glass or sheet metal and also for engaging the steering column 400 from underneath to raise the steering column 400 in a relative vertical position through the windshield 440, with the dash bridge 100 providing a stable surface for applying downward pressure while also providing an upward pressure to raise the hook tool 10.

Figure 3:
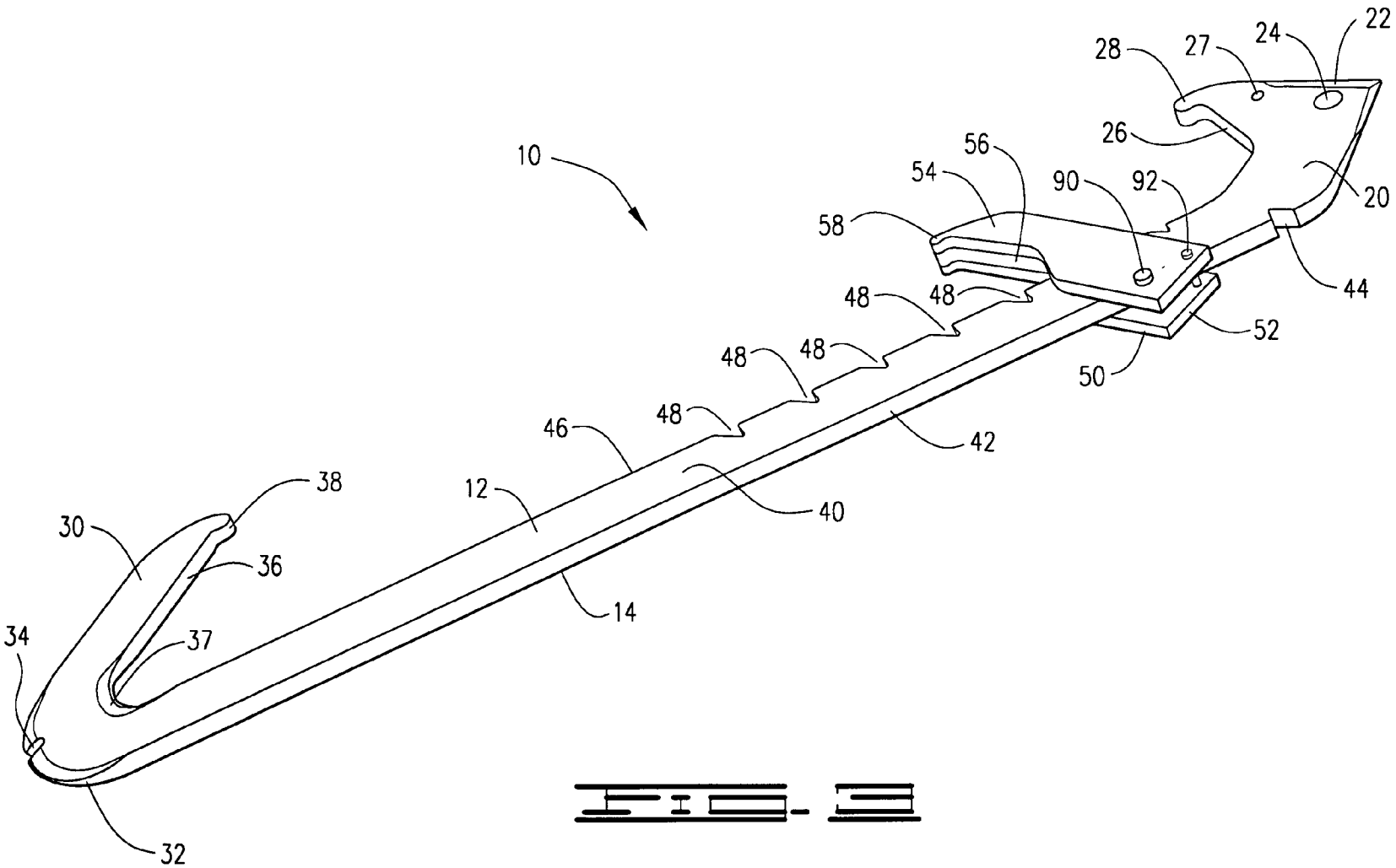
FIG. 3 is a perspective view of the hook tool with the locking hook rocker arm on the hook tool.
Figure 4:
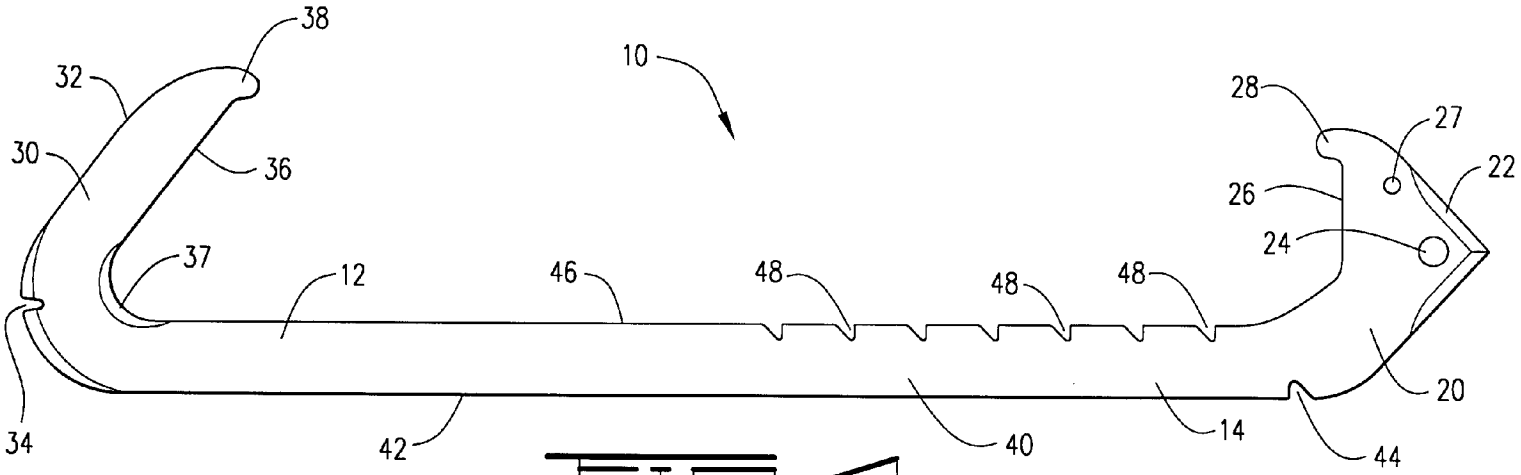
FIG. 4 is a side view of the hook tool without the locking hook rocker arm.
Figure 3:
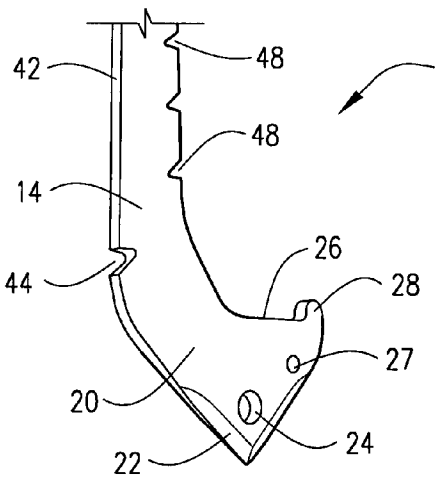
Figure 5:
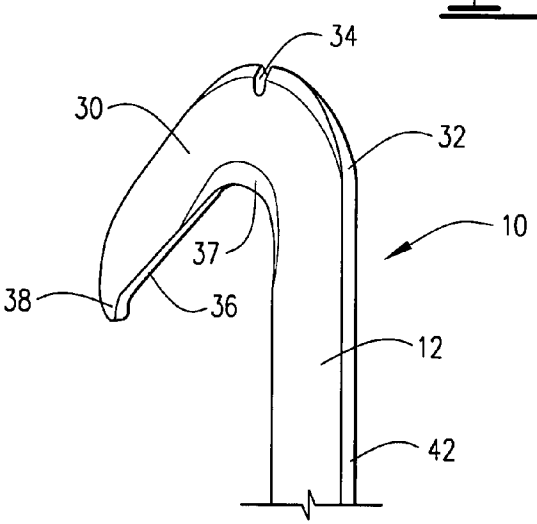
FIG. 5 is an isolated side perspective view of the cutting and gripping end of the hook tool.

More specifically, as indicated in FIGS. 3, and 8–11, the hook tool 10 is made of high density metal of a heavy gauge, the hook tool 10 having a piercing end 20, indicated in FIGS. 3–4 and 6, the piercing end 20 having a beveled outer edge 22, a chain engaging hole 24 penetrating from an upper surface 12 to a lower surface 14, a flattened inner portion 26 and a pry tip 28 extending inward from the flattened inner portion 26, the piercing end 20 forming an overall C-shaped configuration. The beveled outer edge 22 may be used as a chisel or may be placed within a seam in the automobile to pry open a door, remove a door or penetrate a windshield to gain access to the interior of the automobile. This piercing end 20 is generally oriented to extend above and through the windshield when the hook tool 10 is engaged with the steering column 400.

The hook tool 10 also includes a cutting and gripping end 30, shown in FIGS. 3–5, and 10–11, located on the opposing end of the hook tool 10 as the piercing end. The cutting and gripping end 30 has an external edge 32 including a window snapping groove 34, an internal hook portion 36 having a cutting edge 37 for ripping through a windshield and also to firmly engage the underside of the steering column 400 upon which it is engaged. The shape of the cutting and gripping end 30 of the hook tool is a smooth curve, similar to a fishing hook, which tapers into a rounded hook tip 38.

The hook tool 10 also includes a neck 40, between the piercing end 20 and the cutting and gripping end 30. As shown in FIGS. 3–4 and 6, the neck 40 further comprises an outer edge 42 which includes a resting hook arm slot 44 adjacent to the piercing end 20, and an inner edge 46 which includes a plurality of locking hook arm slots 48 located primarily towards the piercing end 20 of the hook tool 10. The resting hook arm slot 44 and the locking hook arm slots 48 are provided to interact with a locking hook rocker arm 50, which may be used with the hook tool 10. The purpose of the locking hook rocker arm 50, shown in FIGS. 7–9 of the drawings, is to allow for an adjustable forcing point along the neck 40 of the hook tool 10 against which pressure may be applied to lift the cutting and gripping end 30 of the hook tool 10 and the attached steering column 400 or other object being pulled by the hook tool 10.

The locking hook rocker arm 50 includes a rocker plate end 54 and slotted neck end 52 formed between a first side plate 60, a second side plate 70 and a central support plate 80 located between the first and second side plates 60, 70, most preferably attached together to form a singular solid piece by welding the first side plate 60 to the central support plate 80 and welding the second side plate 70 to the central support plate 80. When welded together, as in FIG. 7, a flat rocker arm surface 56 terminating in a retaining tip 58 is formed, which is the location against which force may be applied upon the locking hook rocker arm 50.

Figure 7:
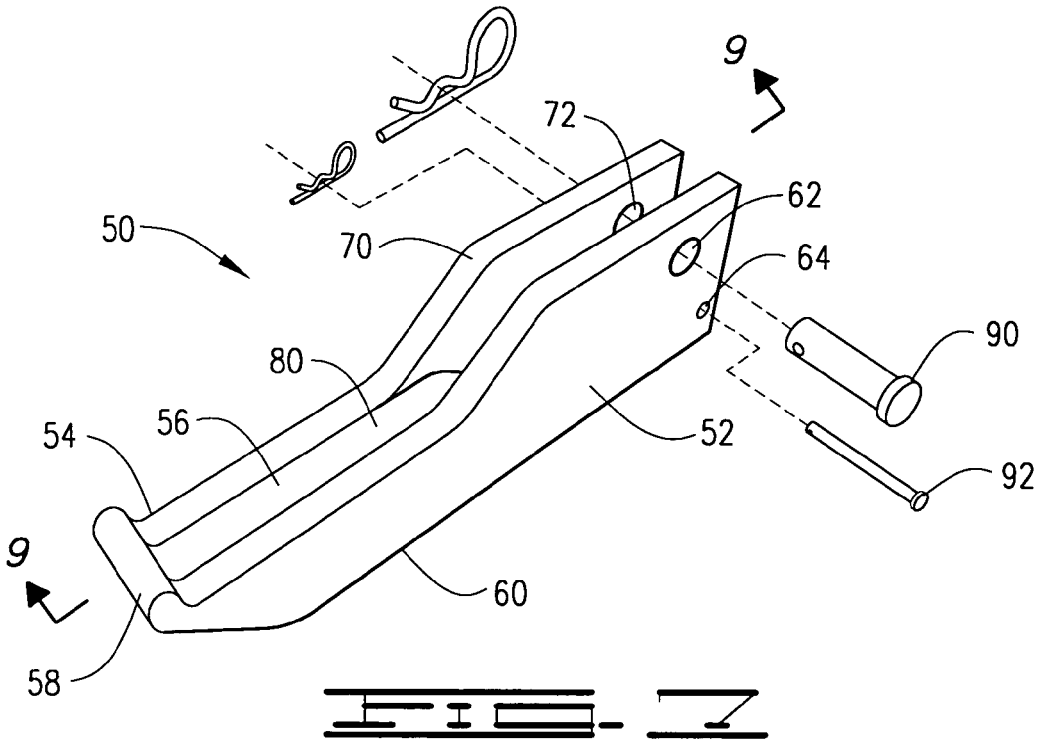
FIG. 7 is an expanded view of the locking hook rocker arm of the hook tool.
Figure 8:
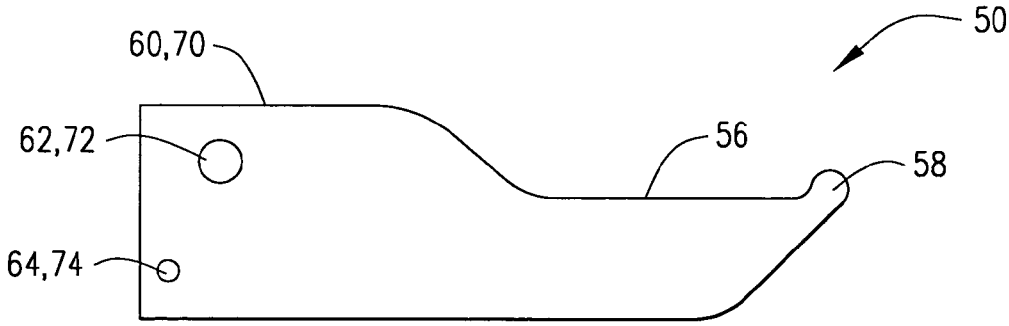
FIG. 8 is a side view of the locking hook rocker arm.
Figure 9:
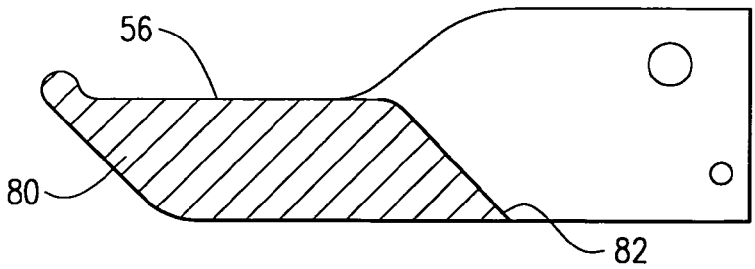
FIG. 9 is a side cross-sectional view of the locking hook rocker arm along section lines 9/9 of FIG. 7.
Figure 10:
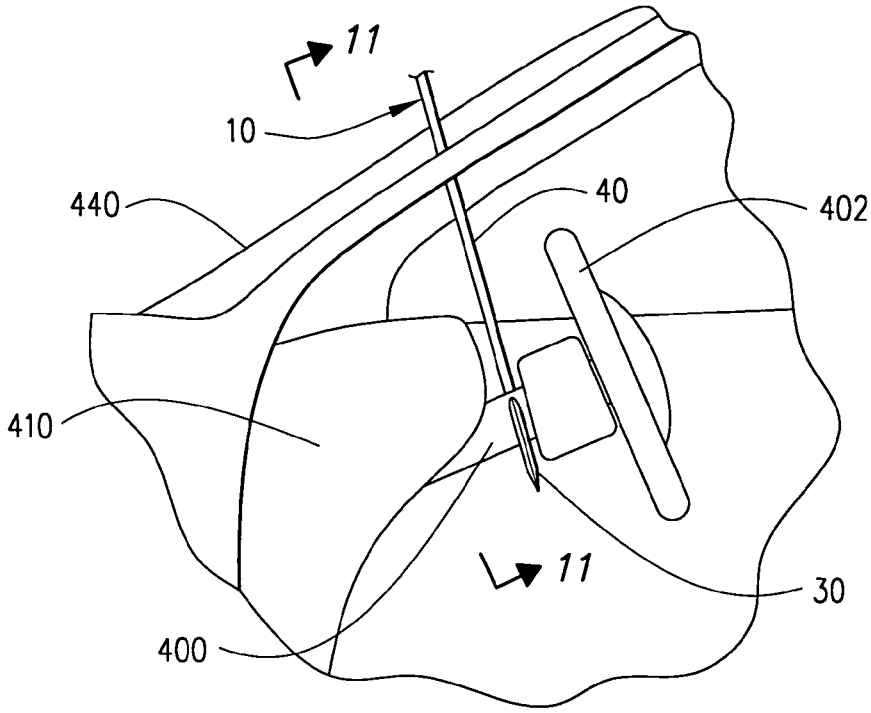
FIG. 10 is an isolated side view of FIG. 2, showing the hook tool engaged on a steering wheel.
Figure 11:
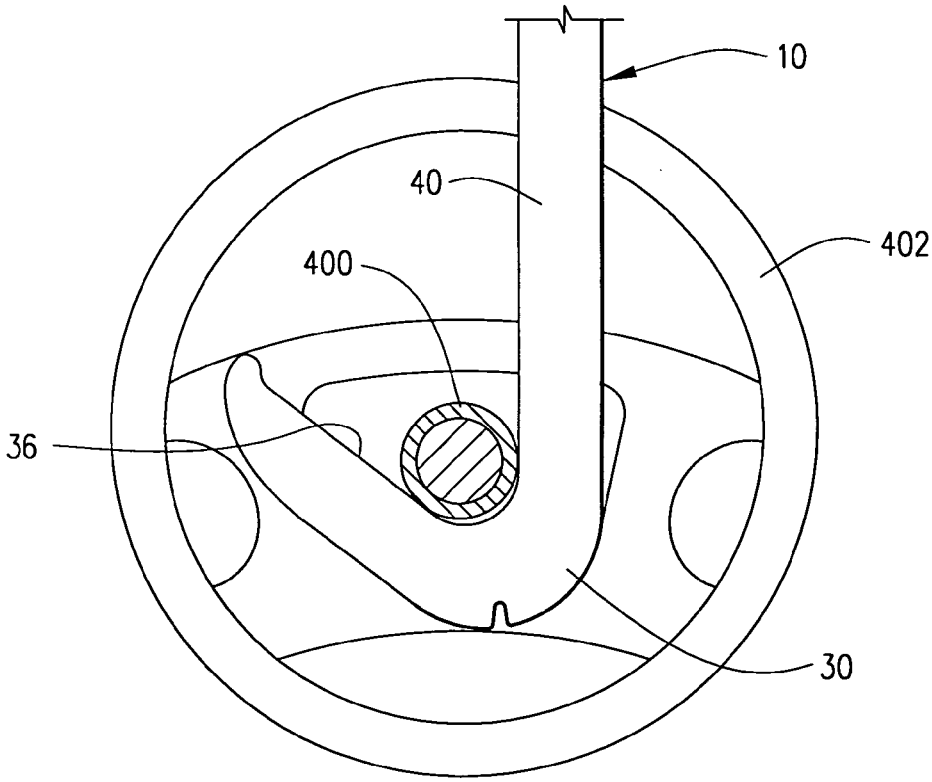
FIG. 11 is a rear view of the cutting and gripping end of the hook engaging a steering column as in FIG. 2.
Figure 7:
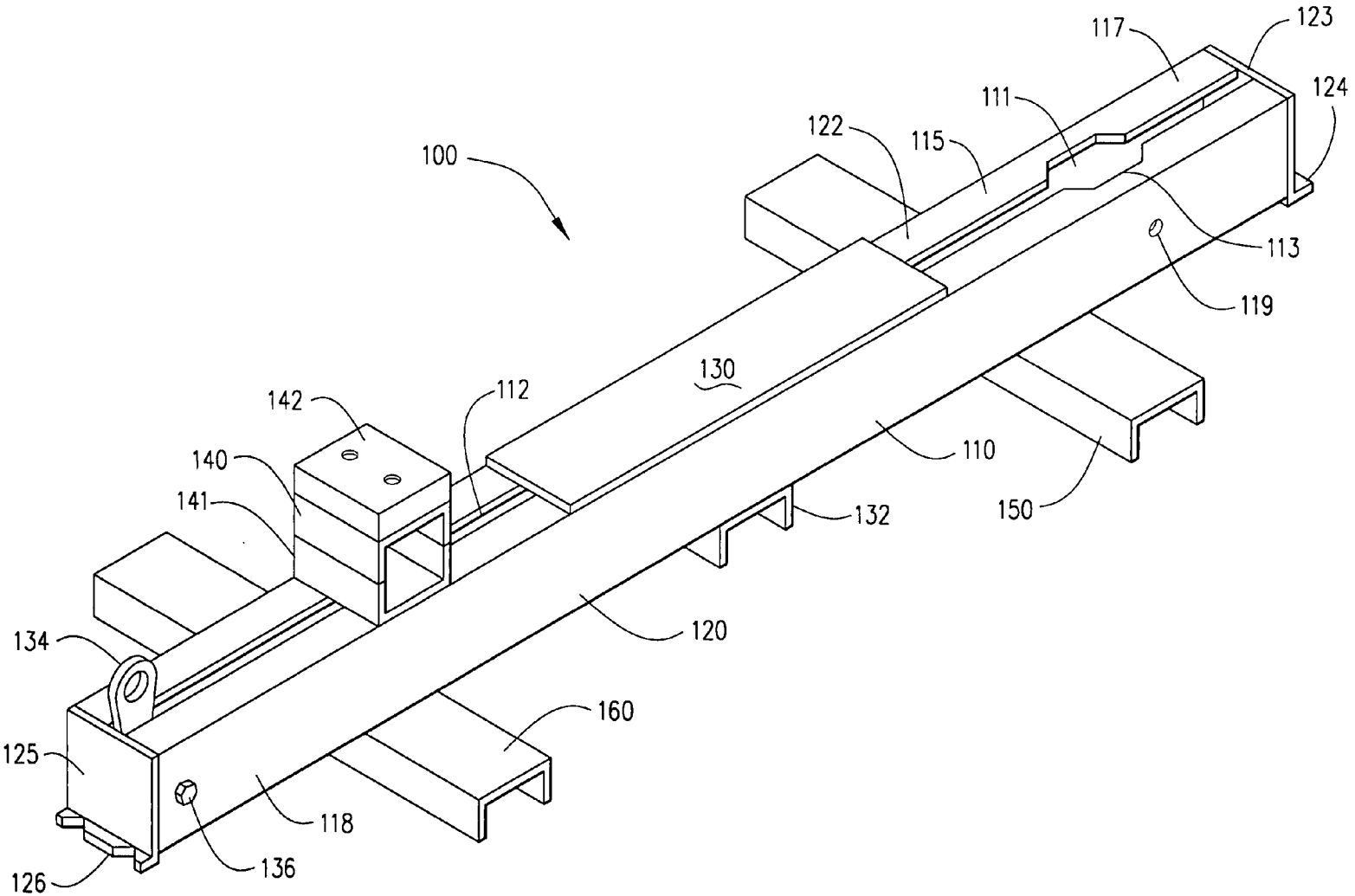

The slotted neck end 52 is positioned against the inner edge 46 of the hook tool 10 and retained on the neck 40 of the hook tool 10 by a pivot cotter pin 90 passed through a first pivot pin hole 62 in the first side plate 60 and an aligned second pivot pin hole 72 in the second side plate 70 across the slotted neck end 52, while a lock cotter pin 92 inserted through a first lock pin hole 64 in the first side plate 60 and a second lock pin hole 74 in the second side plate 70 secondarily retains the locking hook rocker arm 50 along the outer edge 42 of the neck 40 of the hook tool 10, as indicated in FIGS. 3 and 7 of the drawings. The pivot cotter pin 90 is slid along the outer edge 42 of the neck 40 of the hook tool 10 allowing for the locking hook rocker arm 50 to be located at any point along the neck 40. A tooth engaging tip 82 on the central plate 80 is directed towards the inner edge 46 of the neck 40 and lockingly engages the locking hook rocker arm 50 with any one of the plurality of locking hook arm slots 48 on the inner edge 46 of the neck 40 as the rocker plate end 54 is positioned in a perpendicular orientation with the neck 40, the locking hook rocker arm 50 leaned back towards the piercing end 20 when positional movement is desired, and leaned forward towards the cutting and gripping end 30 in a locked position with the tooth engaging tip 82 inserted within one of the plurality of locking hook arm slots 48.

The dash bridge 100, shown specifically in FIGS. 2 and 12–16, further comprises a rectangular and square main support member 110 comprised of a first channel member 120 and a second channel member 122 forming an internal cavity 111, and having an upper surface 115, a lower surface 116, a first end 117 and a second end 118, the first channel member and second channel member aligned parallel forming an upper slide groove 112 having a cable and hook slot 113 and a lower slide groove 114. The first channel member 120 and second channel member 122 are connected by a welded first end cap 123 applied to the first end 117, a second end cap 125 applied to the second end 118, an upper support plate 130 welded to the upper surface 115, and a lower support plate 132 welded to the lower surface 116. A pivotal chain hook 134 may be included at the second end 118 of the main support member 110, pivotally attached between the first channel member 120 and the second channel member 122 by a chain hook bolt 136. The cable and hook slot 113 is located in the upper slide groove 112 near the first end 117 of the main support member 110. A first serrated anchor member 124 projects perpendicularly from the first end cap 123 and a second serrated anchor member 126 projects perpendicularly from the second end cap 125, the first and second serrated anchor members 124, 126 allowing for a penetrating bite into a surface against which the dash bridge 100 is placed, including the hood of a vehicle, or the ground, in the event the hook bridge 100 is alternatively used as a brace to prop up and support an object being lifted which requires stability and bracing for security of the object.

Figure 15:
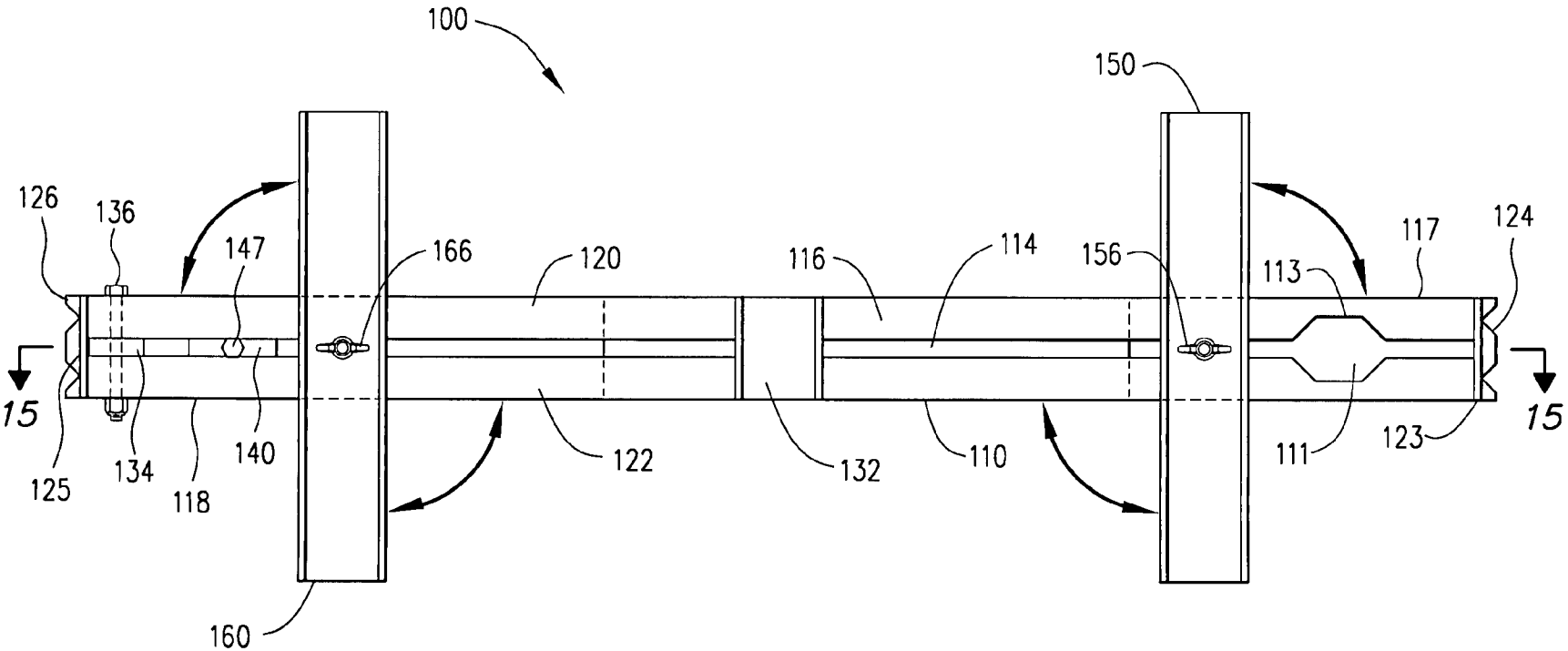
FIG. 15 is a side cross sectional view of the dash bridge in an open position.
Figure 4:
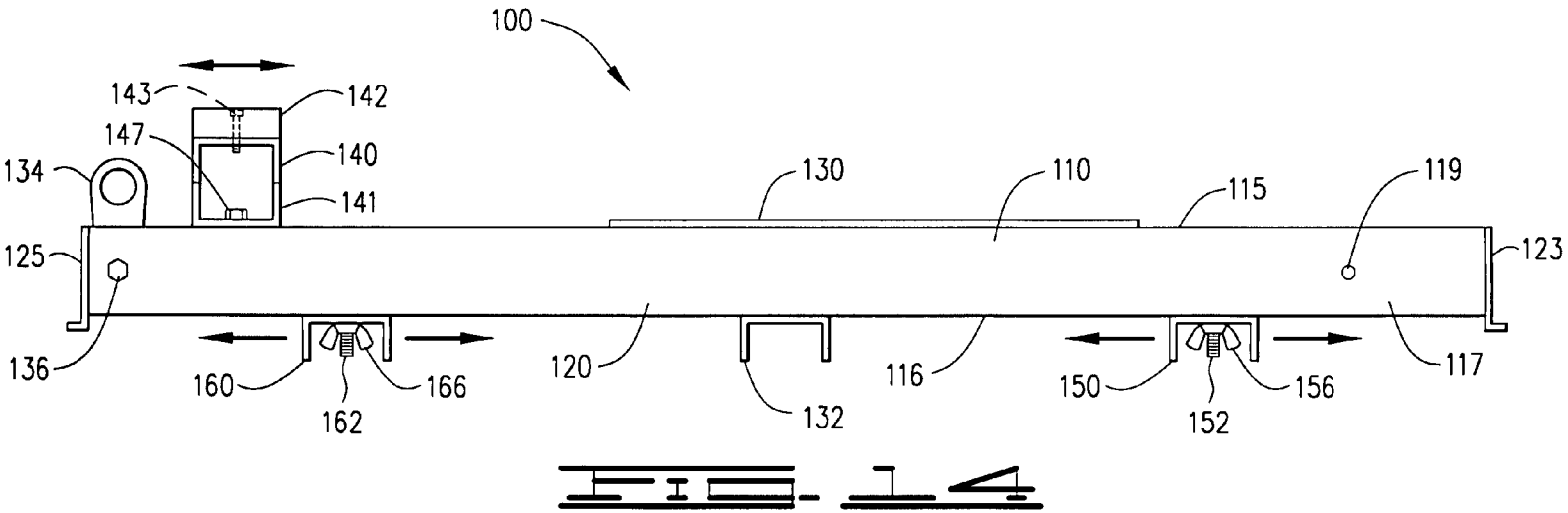
Figure 5:
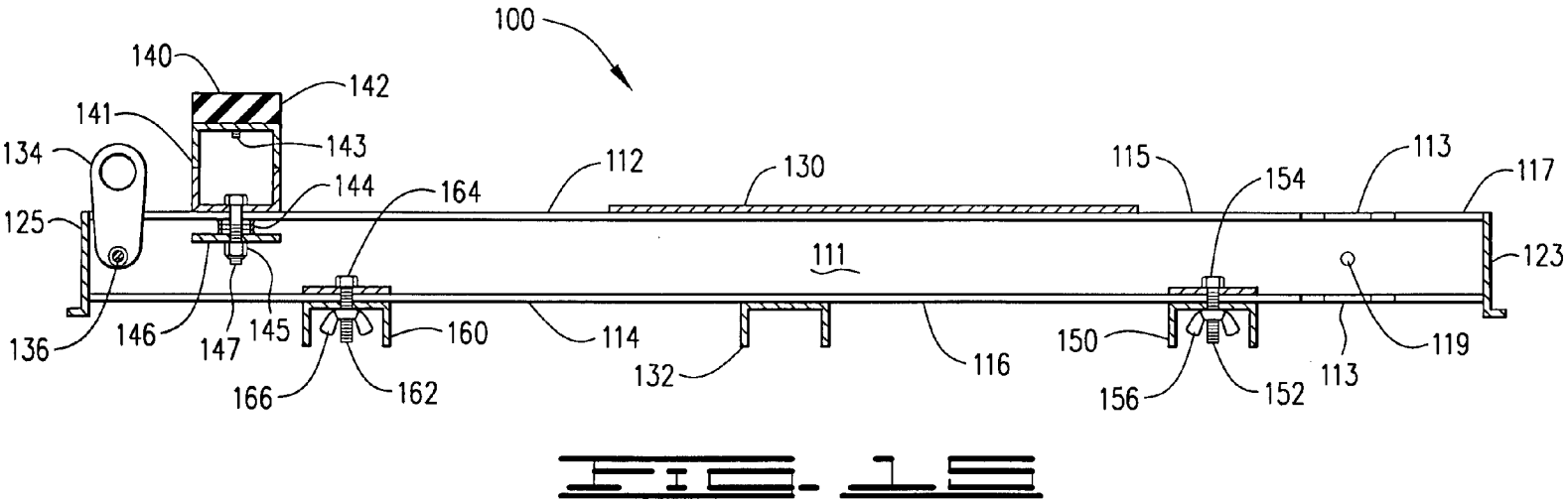
Figure 15:
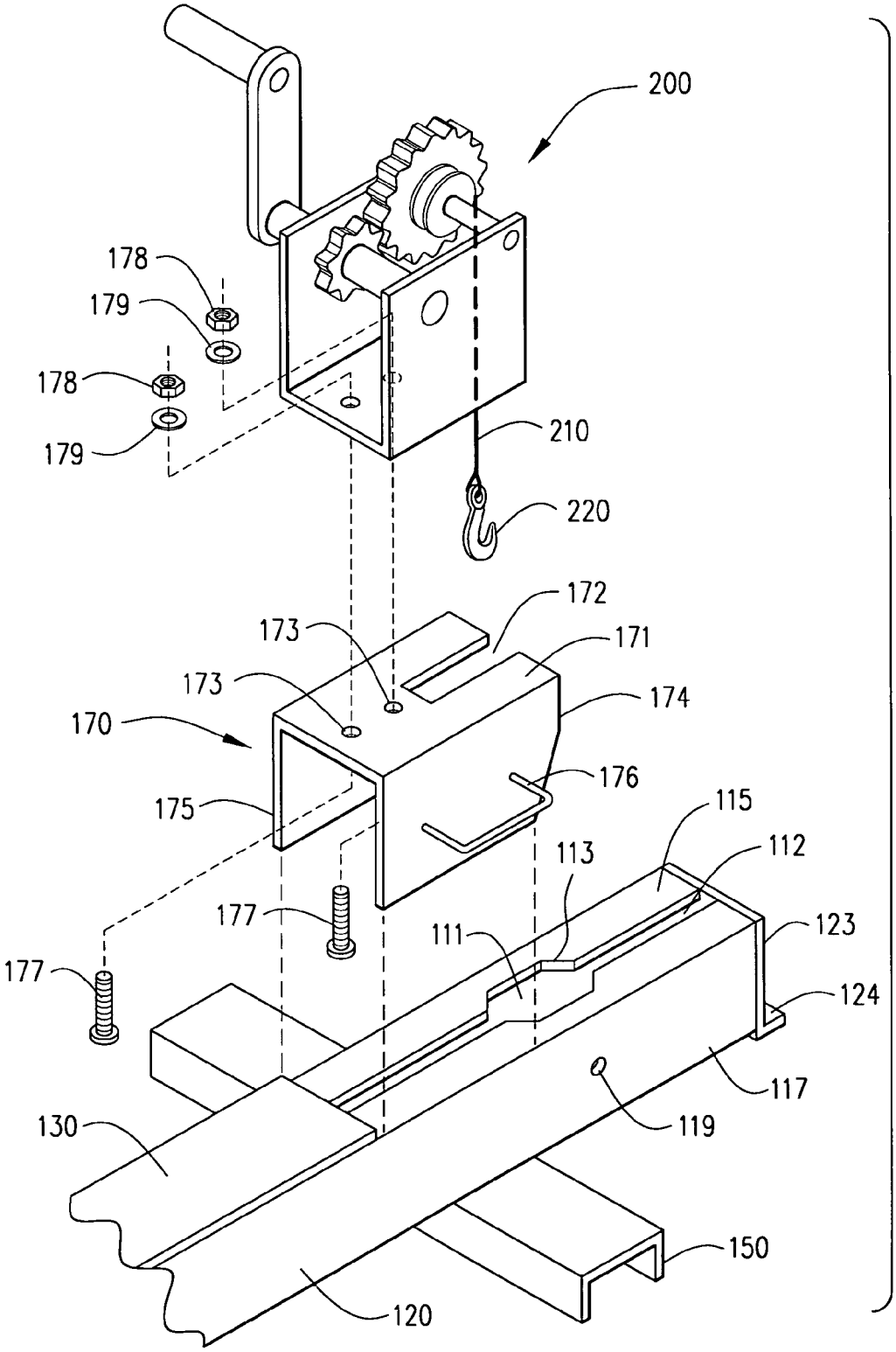

Sliding within the upper slide channel 112 is a sliding platform boot 140 engaged within the upper slide channel 112 by a slide bolt 147 with a spring 144, a carriage washer 146 and a lock nut 145, FIG. 15, extending within the internal cavity 111, retaining the sliding platform boot 140 in a designated location within the upper slide groove 112, between the second end 118 and the upper support plate 130, as shown in FIGS. 12–15. The sliding platform boot also includes a lower support member 141, with a rubber contact plate 142 attached to the lower support member by plate anchor bolts, as in FIG. 14.

A roof support 150 and hood support 160 are each removably and pivotally attached to the lower slide groove 114 by a bolt 152, 162 having a bolt head 154, 164 and wing nut 156, 166, the bolt heads 154, 164 extending within the internal cavity 111 with the wing nuts 156, 166 attaching from below each roof support 160 and hood support 170, shown in FIGS. 13–15. The roof support member 150 is located within the lower slide groove 114 near the first end 117, while the hood support member 160 is located within the lower slide groove 114 near the second end 118 with the lower support plate separating the roof support member and hood support member within the lower sliding groove 114, to prevent the roof support member 150 and hood support member 160 from crossing. The roof support member 150 and hood support member 160 are rotated and aligned with the main support member 110 when stored, to minimize storage space requirements, and perpendicular to the main support member 110 when being used, FIGS. 12–13, and also directed to their respective ends, 117, 118 within the lower slide groove 114, FIG. 14.

In the event that power tools are not available for use with the hook tool 10 and dash bridge 100, an auxiliary winch base 170 mounted to an auxiliary winch 200 with a winch cable 220 and winch hook 220 is provided. The winch 200, winch cable 210 and winch hook 220 are not made part of the claimed invention and are generally provided as a standard hand crank winch, as shown in FIG. 16 of the drawings, but are integral to the use of the auxiliary winch base 170. The winch base 170 is further defined as having an upper plate 171 having a cable slot 172 and at least two winch mounting holes 173, the upper plate 171 attaching to a first side plate 174 and a second side plate 175, the upper plate 171, first side plate 174 and second side plate 175 forming an inverted U-shape, as shown in FIG. 16. The first side plate also includes a carrying handle 176. The auxiliary winch 200 attaches to the upper plate 171 by winch anchor bolts 177, winch anchor nuts 178 and lock washers 179 through the winch mounting holes 173 of the upper plate 171. The auxiliary winch base 170 engages the upper surface 115 of the first end 117 of the dash bridge 100 between the first end cap 123 and the upper support plate 130, with the winch cable 210 and winch hook 220 being dropped through the cable and hook slot 113 of the upper slide groove 112, allowing the winch to be supported upon the dash bridge and pull against an object, including a steering column 400, in the event the hook tool 10 is not used, the auxiliary winch 200 providing the lifting force exerted against the dash bridge 100 to move the object to which force is applied.

For ease of transport and storage, the hook tool 10 may be stored and transported attached within the upper slide groove 112, with the cutting and gripping end 30 of the hook tool latching onto the roof support 150 while the piercing end 20 is retained within the upper slide groove by a slide pin 180 by placing the slide pin 180 through a hook securing pin hole 119 in the first and second channel members 120, 122, passing through the storage pin hole 27 in the piercing end 20 of the hook tool 10.

Figure 2:
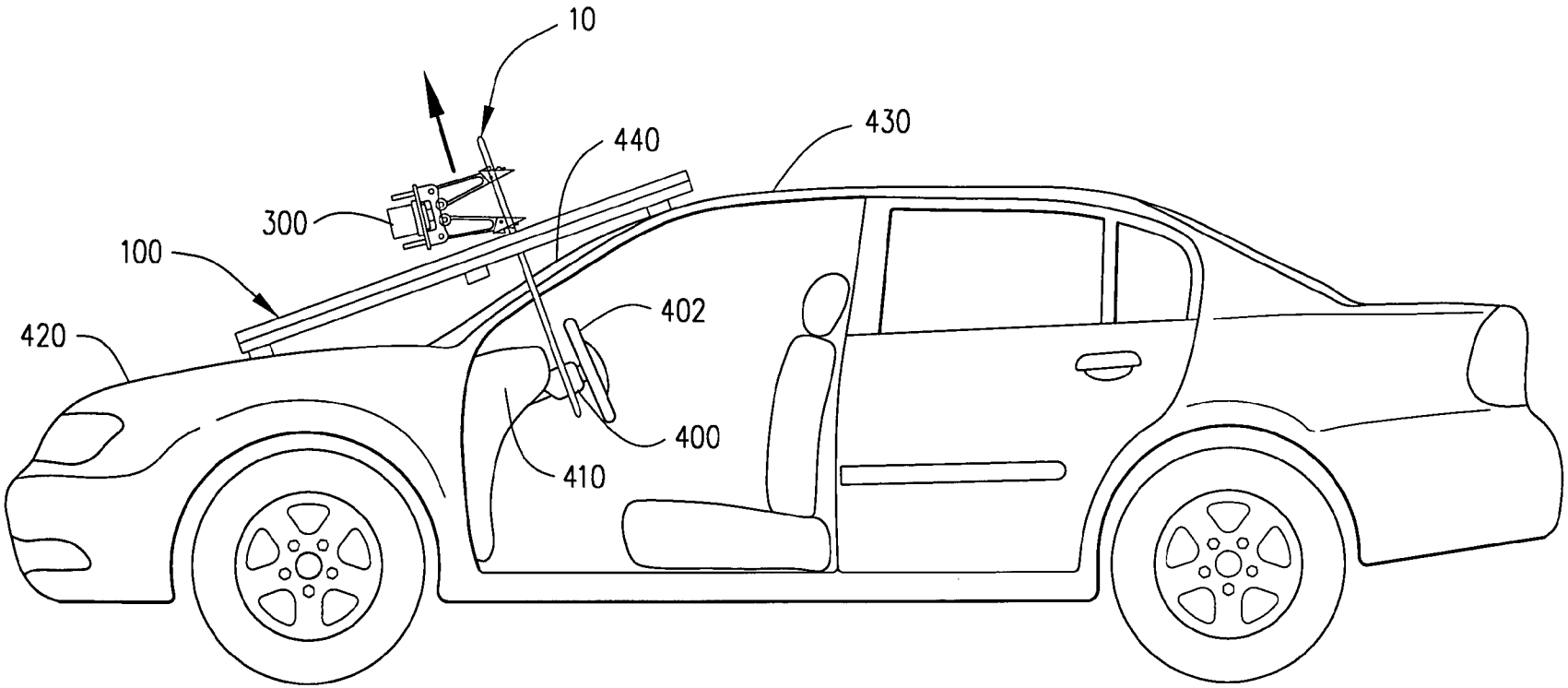
FIG. 2 is a drawing of the dash bridge and hook rescue device positioned on a vehicle in position for pulling the steering column.

A method of using the device, as demonstrated in FIG. 2 of the drawings, would include the steps of disengaging the hook tool 10 from the upper slide groove 112, affixing the roof support 150 and hood support 160 in a perpendicular orientation to the main support member 110, locking the roof support 150 and hood support 160 to the main support member 110 by tightening the wingnuts 156, 166, penetrating the windshield and removing the portion of the windshield deemed appropriate by the recuse personnel, placing the roof support 150 on the roof 430 of the automobile and the hood support 160 on the hood 420 of the automobile with the main support member 110 across the windshield 440, engaging the cutting and gripping end 30 of the hook tool to the underside of the steering column 400 through the opening in the windshield 440 with the piercing end 20 of the hook tool 10 above the sliding platform boot 140 which has been moved into position along the dash bridge 100, placing the extension ram or spreader 300 between the rubber contact plate 142 and the flattened inner portion 26 of the piercing end 20 of the hook tool 10 and forcing the hook tool 10 away from the sliding platform boot 140 on the dash bridge 100, lifting the steering column 400 and dashboard 410 in a relatively vertical direction, off of and away from any victim pinned beneath the steering wheel 402 and dashboard 410.

When the device includes the locking hook rocker arm 50 engaging the neck 40 of the hook tool 10, use of the device would include adjusting the locking hook rocker arm 50 into a position along the neck 40 of the hook tool 10, engaging the tooth engaging tip 82 with one of the plurality of locking hook arm slots 48 and placing the extension ram or spreader 300 between the rubber contact plate 142 and the flat rocker arm surface 56 of the locking hook rocker arm 50 now engaged with the neck 40 of the hook tool 10 and forcing the hook tool 10 away from the sliding platform boot 140 on the dash bridge 100, lifting the steering column 400 and dashboard 410 in a relatively vertical direction, off of and away from any victim pinned beneath the steering wheel 402 and the dashboard 410.

Unlike the prior art, shown in FIG. 1 of the drawings, the entire procedure and method may be employed without access through the doors of the damaged vehicle and also without having to attach a chain to the steering column in and around a trapped and likely severely injured victim.

A similar process is used when no powered spreader 300 is available, except that the auxiliary winch 200 attached to the auxiliary winch base 170 may be applied to the dash bridge 100 after the dash bridge 100 is placed on the hood and roof of the vehicle, after which the winch cable 210 and winch hook 220 may be lowered through the hole in the windshield and attached to a chain wrapped around the steering column 400, or may be attached to the chain engaging hole 24 in the piercing end 20 of the hook tool 10, pulling the chain or hook tool 10 towards the dash bridge 100 up to the cable and hook slot 113.

Although the embodiments of the invention have been described and shown above, it will be appreciated by those skilled in the art that numerous modifications may be made therein without departing from the scope of the invention as herein described. It will also be obvious to those skilled in emergency rescue that the hook tool 10 and dash bridge 100, together or separately, may have uses in emergency rescue not specified in this patent, but which would be utilized with a proper degree of care and safety for other emergency rescue needs including prying metal apart at collapsed seams, penetrating metal, using the hook tool 10 as a lever at the pry tip 28 or rounded hook tip 38, using the dash bridge 100 as a brace or support, and using the hook tool 10 as a vehicle lifting or towing device.

We claim:

1. A dash bridge and hook rescue device used as an emergency rescue tool in conjunction with a manual or powered forcing means or spreader to remove and elevate a collapsed automobile steering column and dashboard in an automobile having a hood, a roof and a windshield, subsequent to an automobile collision in order to extract a driver or passenger from the automobile pinned within the automobile, the dash bridge and hook rescue device essentially comprising:

a hook tool for prying, penetrating, cutting automobile glass or sheet metal and also for engaging said steering column through said windshield to raise said steering column and dashboard; and a dash bridge spanning from said hood of the automobile to said roof of the automobile, providing a stable surface for applying a downward force creating an upward force to raise said hook tool using said manual or powered forcing means or spreader.

2. The device, as disclosed in claim 1, said hook tool further comprising:

a piercing end having a beveled outer edge, a chain engaging hole traversing an upper surface and a lower surface, a flattened inner portion and a pry tip extending inward from said flattened inner portion forming an overall C-shaped configuration;

a cutting and gripping end having an external edge including a window snapping groove, and an internal portion having a cutting edge; and a neck between said piercing end and said cutting and gripping end, comprising an outer edge including a resting hook arm slot adjacent to said piercing end, and an inner edge including a plurality of locking hook arm slots located primarily towards said piercing end of said hook tool.

3. The device, as disclosed in claim 1, said hook tool further comprising:

a piercing end having a beveled outer edge, a chain engaging hole traversing an upper surface and a lower surface, a flattened inner portion and a pry tip extending inward from said flattened inner portion forming an overall C-shaped configuration;

a cutting and gripping end having an external edge including a window snapping groove, and an internal portion having a cutting edge;

a neck between said piercing end and said cutting and gripping end, comprising an outer edge including a resting hook arm slot adjacent to said piercing end, and an inner edge including a plurality of locking hook arm slots located primarily towards said piercing end of said hook tool; and a locking hook rocker arm having a rocker plate end and a slotted neck end, said locking hook rocker arm further comprising a first side plate welded to a central support plate, a second side plate also welded to said central support plate, said first side plate, central support plate and second side plate forming a flat rocker arm surface terminating in a retaining tip, wherein said slotted neck end is positioned against said inner edge of said hook tool and retained on said neck of said hook tool by a pivot cotter pin passed through a first pivot pin hole in said first side plate and an aligned second pivot pin hole in said second side plate across said slotted neck end, while a lock cotter pin is inserted through a first lock pin hole in said first side plate and an aligned second lock pin hole in said second side plate, retaining said locking hook rocker arm along said outer edge of said neck tool, said pivot cotter pin sliding along said outer edge of said neck, said central plate further having a tooth engaging tip directed towards said inner edge of said neck lockingly engaging said locking hook rocker arm with any one of said plurality of locking hook arm slots on said inner edge of said neck.

4. The device as disclosed in claim 1, said dash bridge further comprising:

a main support member formed from a first channel member and a second channel member defining an internal cavity, said main support member having an upper surface, a lower surface, a first end and a second end, said first channel member and said second channel member aligned parallel forming an upper slide groove having a cable and hook slot and a lower slide groove, said first channel member and said second channel member connected together by a first end cap applied to said first end, a second end cap applied to said second end, an upper support plate applied to said upper surface and a lower support plate applied to said lower surface, said first end cap including a first serrated anchor member extending perpendicular from said first end cap, and said second end cap including a second serrated anchor member extending perpendicular from said second end cap;

a sliding platform boot engaging said upper slide channel by a slide bolt, a spring, a carriage washer and a lock nut extending within said internal cavity, retaining said sliding platform boot along said upper slide groove, said sliding platform boot further comprising a lower support member and a rubber contact plate attached to said lower support member by plate anchor bolts;

a roof support removably and pivotally attached to said lower slide groove by a bolt having a bolt head and a wingnut, said bolt head extending within said internal cavity, said roof support located within said lower slide groove near the first end; and a hood support removably and pivotally attached to said lower slide groove by a bolt having a bolt head and a wingnut, said bolt head extending within said internal cavity, said hood support located within said lower slide groove near said second end.

5. The device as disclosed in claim 1, said dash bridge further comprising:

a main support member formed from a first channel member and a second channel member defining an internal cavity, said main support member having an upper surface, a lower surface, a first end and a second end, said first channel member and said second channel member aligned parallel forming an upper slide groove having a cable and hook slot and a lower slide groove, said first channel member and said second channel member connected together by a first end cap applied to said first end, a second end cap applied to said second end, an upper support plate applied to said upper surface and a lower support plate applied to said lower surface, said first end cap including a first serrated anchor member extending perpendicular from said first end cap, and said second end cap including a second serrated anchor member extending perpendicular from said second end cap;

a sliding platform boot engaging said upper slide channel by a slide bolt, a spring, a carriage washer and a lock nut extending within said internal cavity, retaining said sliding platform boot along said upper slide groove, said sliding platform boot further comprising a lower support member and a rubber contact plate attached to said lower support member by plate anchor bolts;

a roof support removably and pivotally attached to said lower slide groove by a bolt having a bolt head and a wingnut, said bolt head extending within said internal cavity, said roof support located within said lower slide groove near the first end;

a hood support removably and pivotally attached to said lower slide groove by a bolt having a bolt head and a wingnut, said bolt head extending within said internal cavity, said hood support located within said lower slide groove near said second end; and an auxiliary winch base attached to an auxiliary winch having a winch cable and winch hook, said auxiliary winch base comprising an upper plate having a cable slot, at least two winch mounting holes, a first side plate and a second side plate attached to said upper plate forming an inverted U-shaped, said auxiliary winch base engaging said upper surface on said first end of said dash bridge between said first end cap and said upper support plate with said winch cable and winch hook passing through said cable and hook slot in said upper slide groove.

6. A dash bridge and hook rescue device used as an emergency rescue tool in conjunction with a manual or powered forcing means or spreader to remove and elevate a collapsed automobile steering column and dashboard in an automobile having a hood, a roof and a windshield, subsequent to an automobile collision in order to extract a driver or passenger from the automobile pinned within the automobile, the dash bridge and hook rescue device comprising:

a hook tool for prying, penetrating, cutting automobile glass or sheet metal and also for engaging said steering column through said windshield to raise said steering column and dashboard, said hook tool further comprising:

a piercing end having a beveled outer edge, a chain engaging hole traversing an upper surface and a lower surface, a flattened inner portion and a pry tip extending inward from said flattened inner portion forming an overall C-shaped configuration;

a cutting and gripping end having an external edge including a window snapping groove, and an internal portion having a cutting edge; and a neck between said piercing end and said cutting and gripping end, comprising an outer edge including a resting hook arm slot adjacent to said piercing end, and an inner edge including a plurality of locking hook arm slots located primarily towards said piercing end of said hook tool; and a dash bridge spanning from said hood of the automobile to said roof of the automobile, providing a stable surface for applying a downward force creating an upward force to raise said hook tool using said manual or powered forcing means or spreader, said dash bridge further comprising:

a main support member formed from a first channel member and a second channel member defining an internal cavity, said main support member having an upper surface, a lower surface, a first end and a second end, said first channel member and said second channel member aligned parallel forming an upper slide groove having a cable and hook slot and a lower slide groove, said first channel member and said second channel member connected together by a first end cap applied to said first end, a second end cap applied to said second end, an upper support plate applied to said upper surface and a lower support plate applied to said lower surface, said first end cap including a first serrated anchor member extending perpendicular from said first end cap, and said second end cap including a second serrated anchor member extending perpendicular from said second end cap;

a sliding platform boot engaging said upper slide channel by a slide bolt, a spring, a carriage washer and a lock nut extending within said internal cavity, retaining said sliding platform boot along said upper slide groove, said sliding platform boot further comprising a lower support member and a rubber contact plate attached to said lower support member by plate anchor bolts;

a roof support removably and pivotally attached to said lower slide groove by a bolt having a bolt head and a wingnut, said bolt head extending within said internal cavity, said roof support located within said lower slide groove near the first end; and a hood support removably and pivotally attached to said lower slide groove by a bolt having a bolt head and a wingnut, said bolt head extending within said internal cavity, said hood support located within said lower slide groove near said second end.

7. The device, as disclosed in claim 6, further comprising:

a locking hook rocker arm having a rocker plate end and a slotted neck end, said locking hook rocker arm further comprising a first side plate welded to a central support plate, a second side plate also welded to said central support plate, said first side plate, central support plate and second side plate forming a flat rocker arm surface terminating in a retaining tip, wherein said slotted neck end is positioned against said inner edge of said hook tool and retained on said neck of said hook tool by a pivot cotter pin passed through a first pivot pin hole in said first side plate and an aligned second pivot pin hole in said second side plate across said slotted neck end, while a lock cotter pin is inserted through a first lock pin hole in said first side plate and an aligned second lock pin hole in said second side plate, retaining said locking hook rocker arm along said outer edge of said neck tool, said pivot cotter pin sliding along said outer edge of said neck, said central plate further having a tooth engaging tip directed towards said inner edge of said neck lockingly engaging said locking hook rocker arm with any one of said plurality of locking hook arm slots on said inner edge of said neck.

8. The device, as disclosed in claim 6, further comprising:

an auxiliary winch base attached to an auxiliary winch having a winch cable and winch hook, said auxiliary winch base comprising an upper plate having a cable slot, at least two winch mounting holes, a first side plate and a second side plate attached to said upper plate forming an inverted U-shaped, said auxiliary winch base engaging said upper surface on said first end of said dash bridge between said first end cap and said upper support plate with said winch cable and winch hook passing through said cable and hook slot in said upper slide groove.

9. The device as disclosed in claim 6, further comprising:

a locking hook rocker arm having a rocker plate end and a slotted neck end, said locking hook rocker arm further comprising a first side plate welded to a central support plate, a second side plate also welded to said central support plate, said first side plate, central support plate and second side plate forming a flat rocker arm surface terminating in a retaining tip, wherein said slotted neck end is positioned against said inner edge of said hook tool and retained on said neck of said hook tool by a pivot cotter pin passed through a first pivot pin hole in said first side plate and an aligned second pivot pin hole in said second side plate across said slotted neck end, while a lock cotter pin is inserted through a first lock pin hole in said first side plate and an aligned second lock pin hole in said second side plate, retaining said locking hook rocker arm along said outer edge of said neck tool, said pivot cotter pin sliding along said outer edge of said neck, said central plate further having a tooth engaging tip directed towards said inner edge of said neck lockingly engaging said locking hook rocker arm with any one of said plurality of locking hook arm slots on said inner edge of said neck; and an auxiliary winch base attached to an auxiliary winch having a winch cable and winch hook, said auxiliary winch base comprising an upper plate having a cable slot, at least two winch mounting holes, a first side plate and a second side plate attached to said upper plate forming an inverted U-shaped, said auxiliary winch base engaging said upper surface on said first end of said dash bridge between said first end cap and said upper support plate with said winch cable and winch hook passing through said cable and hook slot in said upper slide groove.

10. A method of utilizing the device, as disclosed in claim 6, comprising the steps of:

affixing the roof support and hood support in a perpendicular orientation to the main support member;

locking the roof support and hood support to the main support member by tightening the wingnuts;

penetrating the windshield and removing the portion of the windshield deemed appropriate by the recuse personnel;

positioning the roof support on the roof of the automobile and the hood support on the hood of the automobile with the main support member across the windshield;

engaging the cutting and gripping end of the hook tool to the underside of the steering column through the opening in the windshield with the piercing end of the hook tool above the sliding platform boot which has been moved into position along the dash bridge;

placing the extension ram or spreader between the rubber contact plate and the flattened inner portion of the piercing end of the hook tool; and forcing the hook tool away from the sliding platform boot on the dash bridge, lifting the steering column and dashboard in a relatively vertical direction, off of and away from any victim pinned beneath the steering wheel and dashboard.

* * * * *